US008905273B2

(12) United States Patent
de Schrijver

(10) Patent No.: US 8,905,273 B2
(45) Date of Patent: Dec. 9, 2014

(54) AEROSOL VALVE

(75) Inventor: Aster de Schrijver, Deurle (BE)

(73) Assignee: Altachem Holding NV, Deinze (BE)

( * ) Notice: Subject to any disclaimer, the term of this patent is extended or adjusted under 35 U.S.C. 154(b) by 851 days.

(21) Appl. No.: 12/667,720

(22) PCT Filed: Jul. 7, 2008

(86) PCT No.: PCT/EP2008/058811

§ 371 (c)(1),
(2), (4) Date: Jan. 13, 2010

(87) PCT Pub. No.: WO2009/004097

PCT Pub. Date: Jan. 8, 2009

(65) Prior Publication Data

US 2010/0147902 A1 Jun. 17, 2010

(30) Foreign Application Priority Data

Jul. 5, 2007 (EP) ..... 07013147

(51) Int. Cl.

| | |
|---|---|
| ***B65D 83/00*** | (2006.01) |
| ***B65D 83/48*** | (2006.01) |
| ***B65D 83/20*** | (2006.01) |
| ***B65D 83/28*** | (2006.01) |
| ***B65D 83/34*** | (2006.01) |
| ***B65D 83/46*** | (2006.01) |
| ***B65D 83/14*** | (2006.01) |

(52) U.S. Cl.

CPC ..... *B65D 83/48* (2013.01); *B65D 83/201* (2013.01); *B65D 83/28* (2013.01); *B65D 83/345* (2013.01); *B65D 83/46* (2013.01); *B65D 83/753* (2013.01); *B65D 83/756* (2013.01)

USPC ..... 222/402.21; 222/402.1; 222/402.24

(58) Field of Classification Search

USPC ..... 222/402.1, 402.21, 402.24, 501, 542, 222/464.1; 251/354

See application file for complete search history.

(56) References Cited

U.S. PATENT DOCUMENTS

| | | | | |
|---|---|---|---|---|
| 2,829,806 | A | 4/1958 | Tedaldi | |
| 2,889,086 | A * | 6/1959 | Collins | 222/402.22 |
| 3,593,895 | A * | 7/1971 | Green et al. | 222/402.24 |
| 3,813,013 | A * | 5/1974 | Kotuby et al. | 222/402.2 |
| 4,824,075 | A * | 4/1989 | Holzboog | 251/349 |
| 4,908,884 | A | 3/1990 | John et al. | |
| 4,958,755 | A * | 9/1990 | Gerstung | 222/402.23 |
| 5,014,887 | A * | 5/1991 | Kopp | 222/402.1 |
| 8,074,848 | B2 * | 12/2011 | Pittl et al. | 222/402.24 |

FOREIGN PATENT DOCUMENTS

| | | | |
|---|---|---|---|
| DE | 4443287 | A1 | 6/1996 |
| EP | 1606195 | A1 | 12/2005 |
| WO | 2004083074 | A1 | 9/2004 |

* cited by examiner

*Primary Examiner* — Paul R Durand
*Assistant Examiner* — Vishal Pancholi
(74) *Attorney, Agent, or Firm* — Levy & Grandinetti

(57) ABSTRACT

The present invention is a valve for a container. The valve includes a grommet defining a channel with an inlet end and an outlet end. The valve has a stem, slideably arranged in the channel, and the grommet includes a first part provided at the inlet end and a second part provided at the outlet end. The first part has a hardness greater than the hardness of the second part.

12 Claims, 18 Drawing Sheets

AEROSOL VALVE

FIELD OF THE INVENTION

The present invention relates to a new aerosol valve for a pressurized fluid container, more particularly for one component polyurethane foam applications.

BACKGROUND OF THE INVENTION

It is known generally known to store fluids under pressure in containers (cans or vessels) in a wide field of applications. The fluids are usually dispensed from the container by means of a valve arranged in a cup of the container.

A well-known application is sprayable foams used in both industrial applications and by hobbyists. As such, containers with sprayable foam can be exposed to rather extreme conditions in terms of temperature and pressure.

Under these extreme conditions, the pressure in the container may rise and the valve may detach from the container creating potential safety issues.

In order to prevent the above, several safety measures are used, such as providing an overpressure relief valve or providing "burst parts" in the container. However, the use of overpressure relief valves is expensive, while providing weakened "burst parts" in the container is no option for containers that are used on building sites as unintended burst of the container may be triggered by the nature of use of these containers.

Still, in order to prevent the valve from detaching from the container due to overpressure, it is possible to mould part of the grommet over the container cup. However, the overmoulding is a cost inefficient process.

It has now been found that the new valve of the present invention overcomes the above mentioned drawbacks.

The valve according to the present invention is a valve for a container, the valve comprising a grommet defining a channel with an inlet end and an outlet end; a stem, slideably arranged in said channel; the grommet comprising a first part provided at said inlet end and a second part provided at said outlet end, characterized in that the first part has a hardness greater than the hardness of the second part.

In addition, it has been found that the valve is sufficiently resilient while equally being moisture resistant thereby avoiding stickiness and blockage of the valve.

Use of dual plastic grommet in a valve for a container has already been disclosed in EP 1,606,195. The invention describes a valve comprising a grommet having at least one part made of non-thermoplastic rubber and another part made of a thermoplastic material. Although a thermoplastic material has been used to provide hydrophobic properties and avoid diffusion/absorption of ambient moisture in the container through the valve, thermoplastic materials exhibit other inconveniences such as "creep", which is a well known property of thermoplastic (TP) rubbers. This creep allows for the materials to deform and causes the grommet to detach from the cup when the container is put under extreme pressure.

Given the above, the present invention provides a valve for a container dispensing a pressurized fluid and an assembly applied for dispensing of pressurized fluids with low creep properties and sufficient resilience while avoiding the use of an embedding or molding step and avoiding the necessity of using of a spring.

In addition, a valve is provided for a container dispensing pressurized fluids which valve is moisture repellent and therefore will inhibit the water diffusion and/or absorption that is causing stickiness and blockage of the valve.

None of the prior art discloses the valve according to the present invention nor do these documents suggest the presently obtained benefits associated therefrom.

SUMMARY OF THE INVENTION

The present invention concerns a valve for a container, the valve comprising:

a grommet defining a channel with an inlet end and an outlet end;

a stem, slideably arranged in said channel;

the grommet comprising a first part provided at said inlet end and a second part provided at said outlet end, characterized in that the first part has a hardness greater than the hardness of the second part.

DESCRIPTION OF THE INVENTION

The present invention relates to a valve for a container, the valve comprising:

a grommet defining a channel with an inlet end and an outlet end;

a stem, slideably arranged in said channel;

the grommet comprising a first part provided at said inlet end and a second part provided at said outlet end, characterized in that the first part has a hardness greater than the hardness of the second part.

An advantage of a valve according to the present invention is that, when mounted in the cup of a container, the first (hard) part is located inside the container and prevents the valve from detaching from the cup when overpressure occurs inside the container.

Another advantage of the present invention is that the valve can be assembled separately from the container, as no overmoulding is required to fasten the valve to the container's cup, thereby simplifying production and reducing production cost.

Said first part of the container is preferably manufactured from a material having a hardness of at least Shore D25, more preferably a hardness comprised between Shore D25 and Shore D90 and even more preferably a hardness of Shore D30.

The first part of the grommet is preferably manufactured in a hydrophobic thermoplastic material. An advantage thereof is that polyurea formed by a reaction of polyurethane and ambient water ingress in the container, will not stick on the first part. Hence proper sealing of the valve by the stem can be achieved during entire lifetime of the container.

For a same reason as mentioned above, it is preferred that the stem also is manufactured in a hydrophobic material, preferably a hydrophobic thermoplastic material.

DESCRIPTION OF A PREFERRED EMBODIMENT

Figure 1:
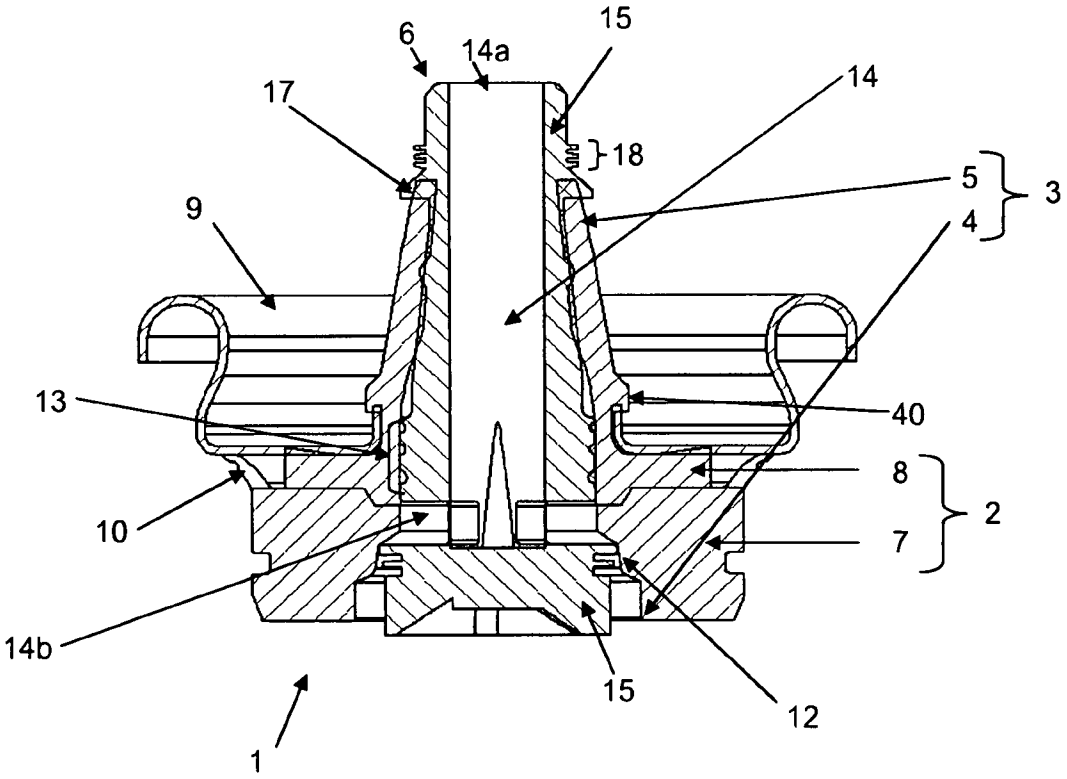
FIG. 1 schematically represents a valve according the present invention for a container dispensing a pressurized fluid.

Referring to FIG. 1, and in accordance with the present invention, a valve (1) for a container dispensing a pressurized fluid is presented, the valve (1) comprising a grommet (2) defining a channel (3) with an inlet end (4) and an outlet end (5), a stem (6) slideably arranged in the channel (3), the grommet (2) comprising a first part (7) provided at said inlet end (4) and a second part (8) provided at said outlet end (5), characterized in that said first part (7) has a hardness higher than the hardness of said second part (8).

The valve (1) is designed to be provided in an opening of a container cup (9) for controlling dispensing a fluid from said container.

Figure 2:
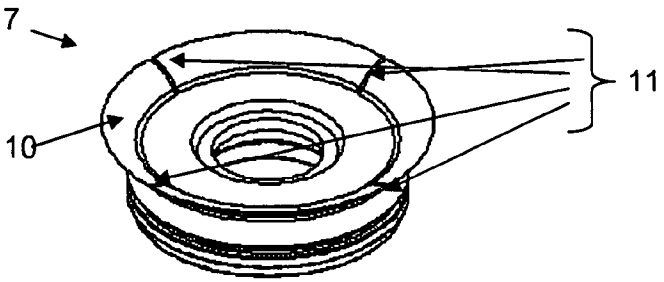
FIG. 2 schematically represent a first part of the grommet comprising a radially outwardly extending sealing lip.
Figure 3:
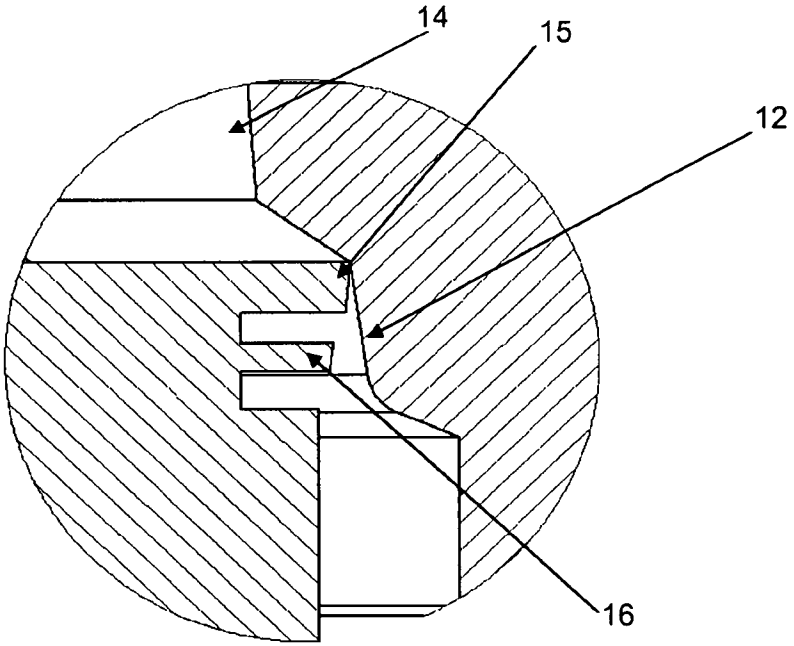
FIG. 3 schematically represents a first and a second disk-shaped resilient lip section onto the stem.
Figure 4:
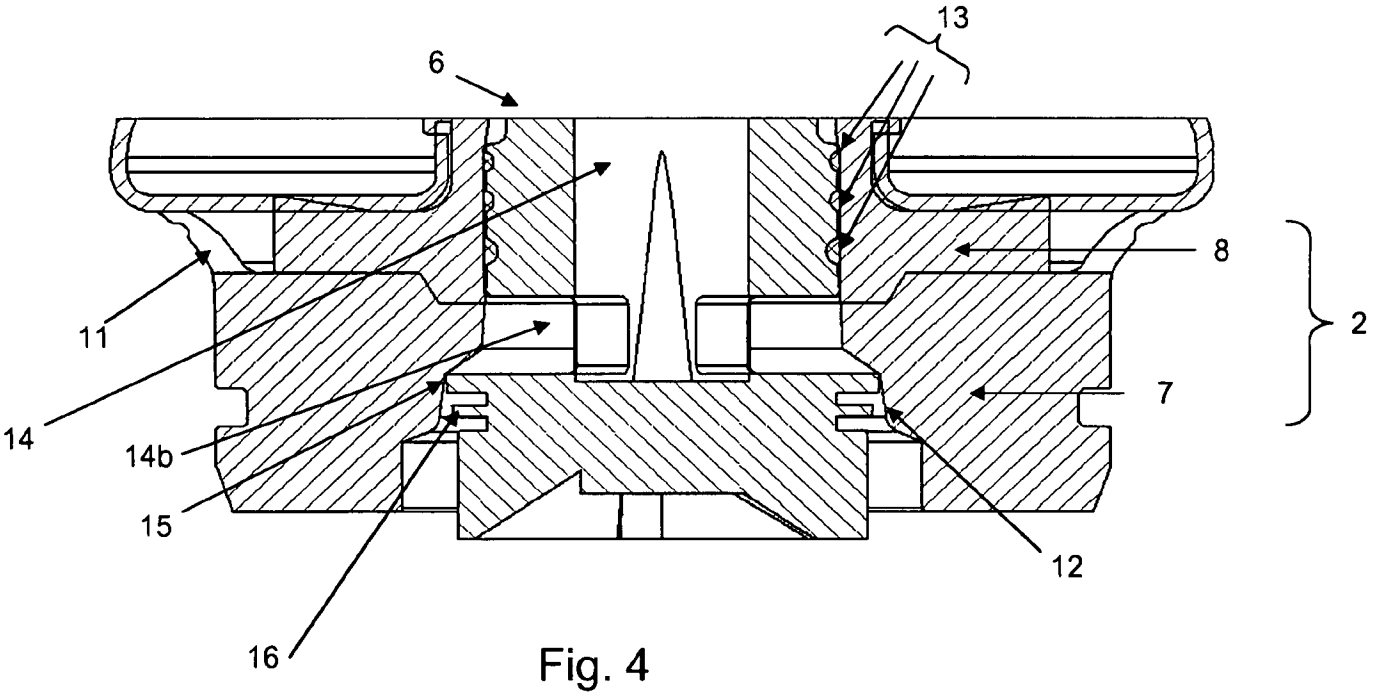
FIG. 4 schematically represents the stem sealed to the first and second part of the grommet.

The first part (7) is formed in the shape of a ring, centrally defining the inlet end (4) of said channel (3). The outer diameter of the first part (7) is larger than the inner diameter of the opening of the container cup (9). The first part (7) preferably comprises a radially outwardly extending sealing lip (10) which in this case, comprises incisions (11), such as illustrated in FIG. 2. As illustrated in FIG. 3 and in more detail in FIG. 4, the inner wall of the first part (7) is provided with a shoulder portion (12) conically shaping the inlet end (4) of the first part (7) of the grommet (2).

According to a preferred embodiment, the first part (7) is made of material having a hardness of at least Shore D25. Preferably, the first part (7) has a hardness in the range between Shore D25 and D90. More preferably, the first part (7) has a hardness of Shore D30.

The International Standard EN ISO 868:2003 specifies a method for the determination of the indentation hardness of plastics and ebonite by means of durometers (Shore hardness) of two types: type A is used for softer materials and type D for harder materials.

Further, the material used for the first part (7) preferably has a Young's modulus of elasticity in the range between 750 MPa and 7000 MPa. In a preferred embodiment, the first part (7) is made of a thermoplastic material, such as polypropylene or polyethylene. Both materials can be strengthened with reinforcing additives such as glass fibre.

Figure 5:
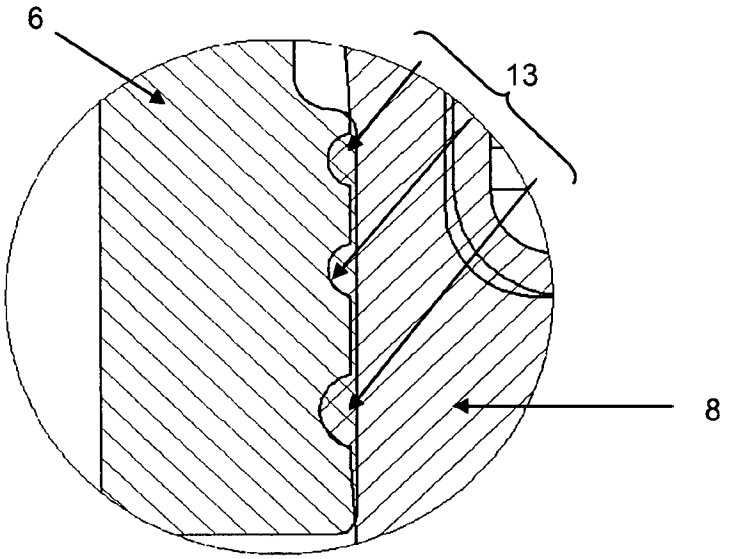
FIG. 5 schematically represents three inwardly extending sealing lips (13) sealing the second grommet part onto the stem.

The second part (8) preferably has a ring form defining part of said channel (3) and extending from the ring form is a conically shaped wall portion defining the outlet end (5) of said channel (3). Said wall portion is preferably with an annular extending protrusion (40) provided at a distance of the ring form. In the present embodiment, the ring form of the second part (8) of the grommet (2) is adhered to the first part (7) of the grommet (2). The second part (8) of the grommet (2) preferably comprises at least one, and in this case three inwardly extending sealing lips (13), illustrated more in detail in FIG. 5.

According to the present invention, the hardness of the first part (7) is higher than the hardness of the second part (8) of the grommet (2). The second part (8) preferably is made of material having a hardness in the range between Shore A35 and Shore A90, more preferably, between Shore A70 and Shore A85 and even more preferably a hardness of Shore A77. The second part (8) can for example be made of a thermoplastic elastomer, such as styrene-butadiene, butylene-styrene, silicone rubbers, isopropyl ether (Kraton, Shell), chlorinated polyethylene (Tyrin, Dupont de Nemours), epichlorhydrin homopolymers or copolymer, ethylene propylene (Nordel, Dupont de Nemours), fluoroelastomers (Viton, Dupont de Nemours), alcryn MPR (chlorinated olefin interpolymer alloy), Santoprene, Vegaprene, Geolast, Thermolast and Trefsin (Advanced Elastomer Services (EXXON).

Figure 6:
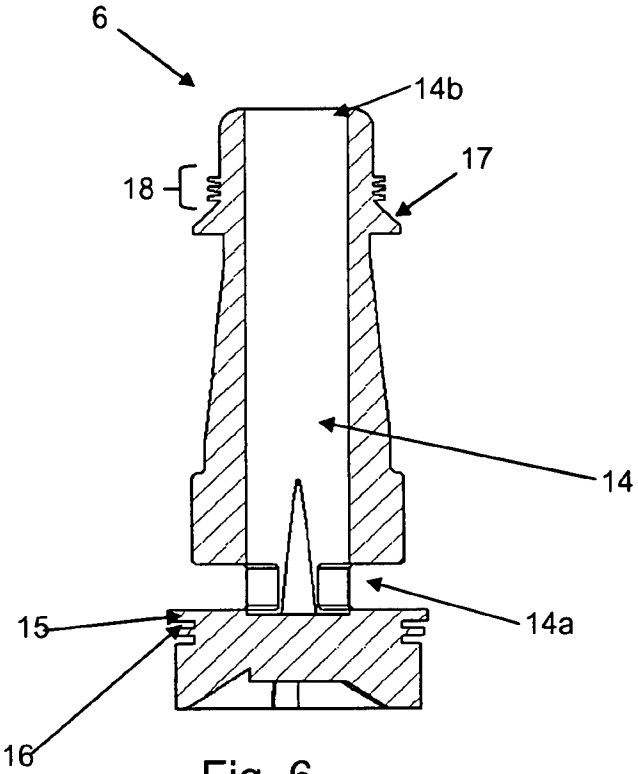
FIG. 6 schematically represents a stem.
Figure 7B:
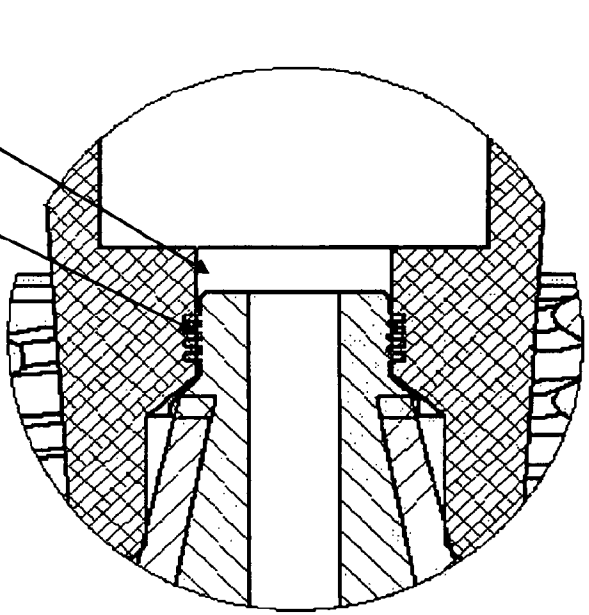
FIG. 7 schematically represents the sealing of the stem onto the conical adaptor valve seat.
Figure 7A:
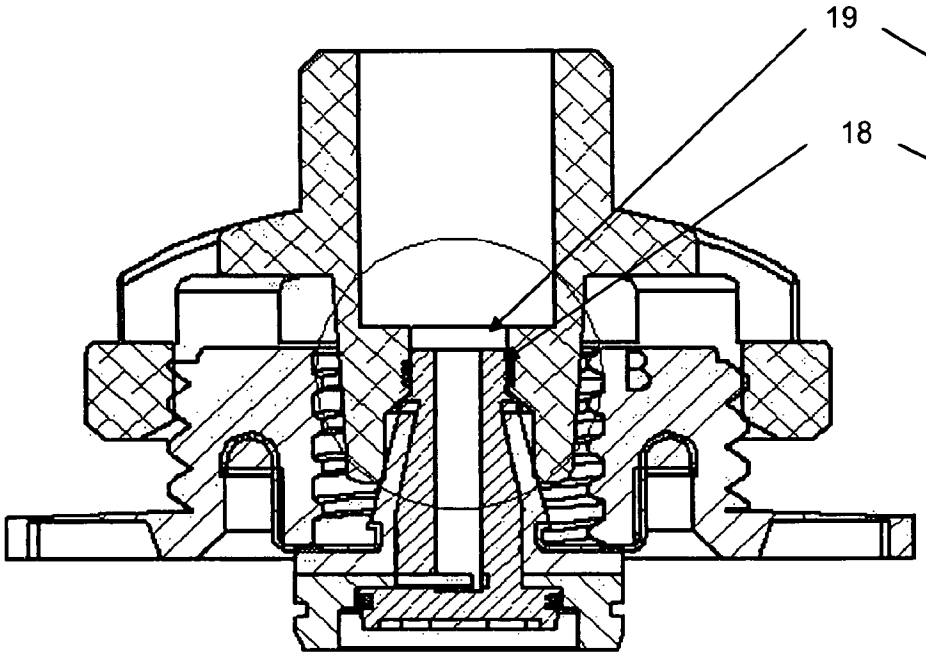

As illustrated in FIG. 6, the stem (6) comprises a disk-shaped base and a conical protrusion extending therefrom, said conical protrusion defining a dispensing channel (14) with an inlet (14*a*) adjacent to said disk and an outlet end (14*b*) at the distal end of the protrusion. The inlet (14*a*) is defined by holes in the conical protrusion adjacent the disk-shaped base. The stem (6) preferably comprises a first (15) and a second (16) disk-shaped resilient lip section, both provided at the outer circumference of the disk-shape base. The diameter of the first disk-shaped resilient lip section (15) is preferably larger than the diameter of the second disk-shaped resilient lip section (16). The stem (6) further comprises a circular sealing lip (17) located near the distal end and at least one, and in this case three disk-shaped resilient lip sections (18), as illustrated in FIGS. 7*a* and 7*b*. Preferably, the stem (6) is made of a hydrophobic thermoplastic material, such as polypropylene or polyethylene. Both materials can be strengthened by reinforcing additives such as glass fibre.

In an assembled composition, the stem (6) is inserted into the channel (3) of the grommet (2) whereby the grommet (2) is clamped between circular sealing lip (17) at the outlet end (5) and the disk-shaped base at the inlet end (4) of the channel (3). The stem (6) is hereby in sealing contact with the inner walls of the channel (3), which sealing is ascertained by, on the one hand the first (15) and a second (16) disk-shaped resilient lip section abutting the conical shoulder portion (12) of the first part (7) of the grommet (2), and on the other hand the annular extending protrusion (40) abutting the conical protrusion of the stem (6). It is noticed that when assembled, the holes defining the inlet (14*a*) of the dispensing channel (14) are arranged opposite the first grommet part (7) and at least at a distance of the second grommet part (8).

As represented in FIG. 1, the valve is meant to be incorporated in the opening of a container's cup (9) whereby the inner wall portion of said container's cup (9) opening is fixedly clamped between the ring form and the annular extending protrusion (40) of the second part (8) of the grommet (2), thereby providing a first sealing function. Clearly, the first part (7) of the grommet (2) is positioned in the container. It is further noticed that the second grommet part (8) preferably has an outer diameter larger than the inner diameter of the cup's opening, in order to help preventing the valve (1) from accidentally detaching from the cup (9).

As the second part (8) of the grommet (2) is made of a resilient material, a good sealing can be obtained between the cup (9) and the grommet (2). Further, an additional sealing is obtained by the radially outwardly extending sealing lip (10) of the first grommet part (7) abutting the container's cup (9).

In operation, the stem (6) can be slided between an open and closed position of the valve (1). In rest, the valve (1) is closed due to the resilience of the conical protrusion, pressing the disk-shaped part of the stem (6) against the shoulder portion (12) of the inner wall of the first grommet part (7). To open the valve (1), the stem (6) is pushed in a direction towards the container whereby the inlet (14*a*) of the dispensing channel (3) is in fluid communication with the container's inner space. Once the pressure on the stem (6) is released, it will be forced in a closed position again by the resilience of the second part (8) of the grommet (2) and by the pressure inside the container. As the holes at the inlet (14*a*) of the dispensing channel (3) are in both a closed and open position of the valve (1), located at a distance of the second grommet part (8), the fluid in the container will not contact the second grommet part (8), thereby avoiding sticking of the material against the inner side of the grommet (2) and hence avoiding blocking of the valve function. Contact between the second grommet part (8) and the fluid in the container is further prevented by sealing lip (10). The resilience whereof can be adapted by providing incisions.

Figure 8:
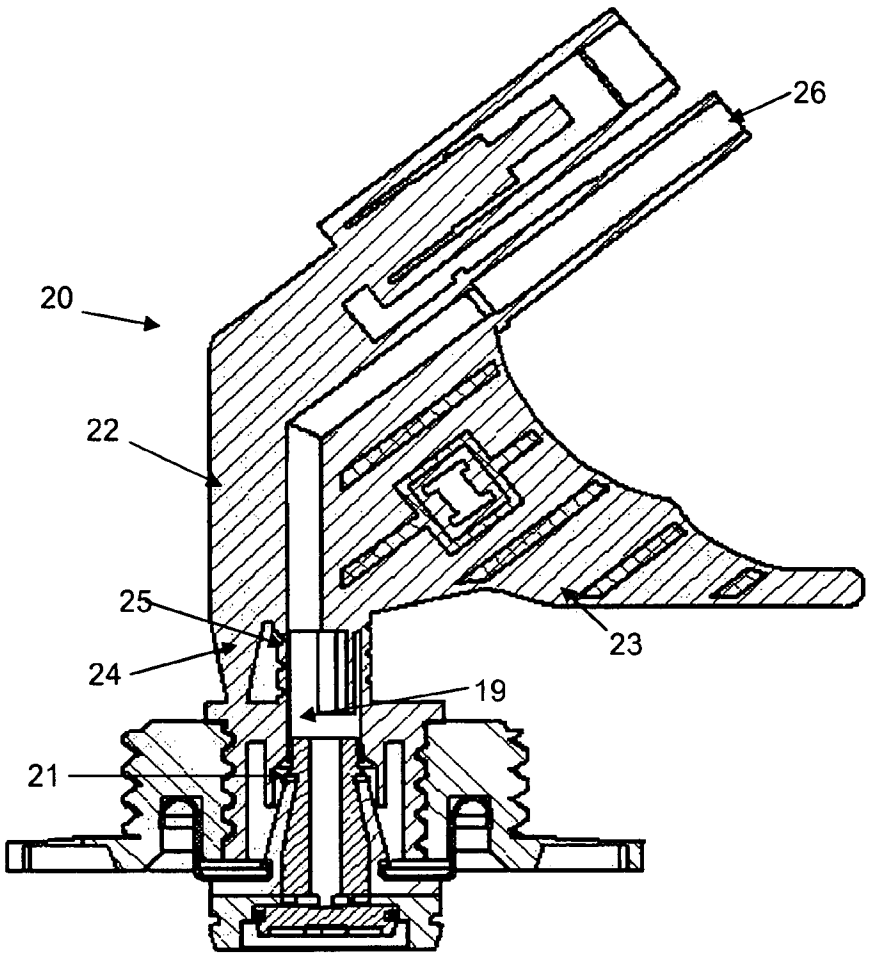
FIG. 8 schematically represents a foam applicator mounted onto the valve.
Figure 9:
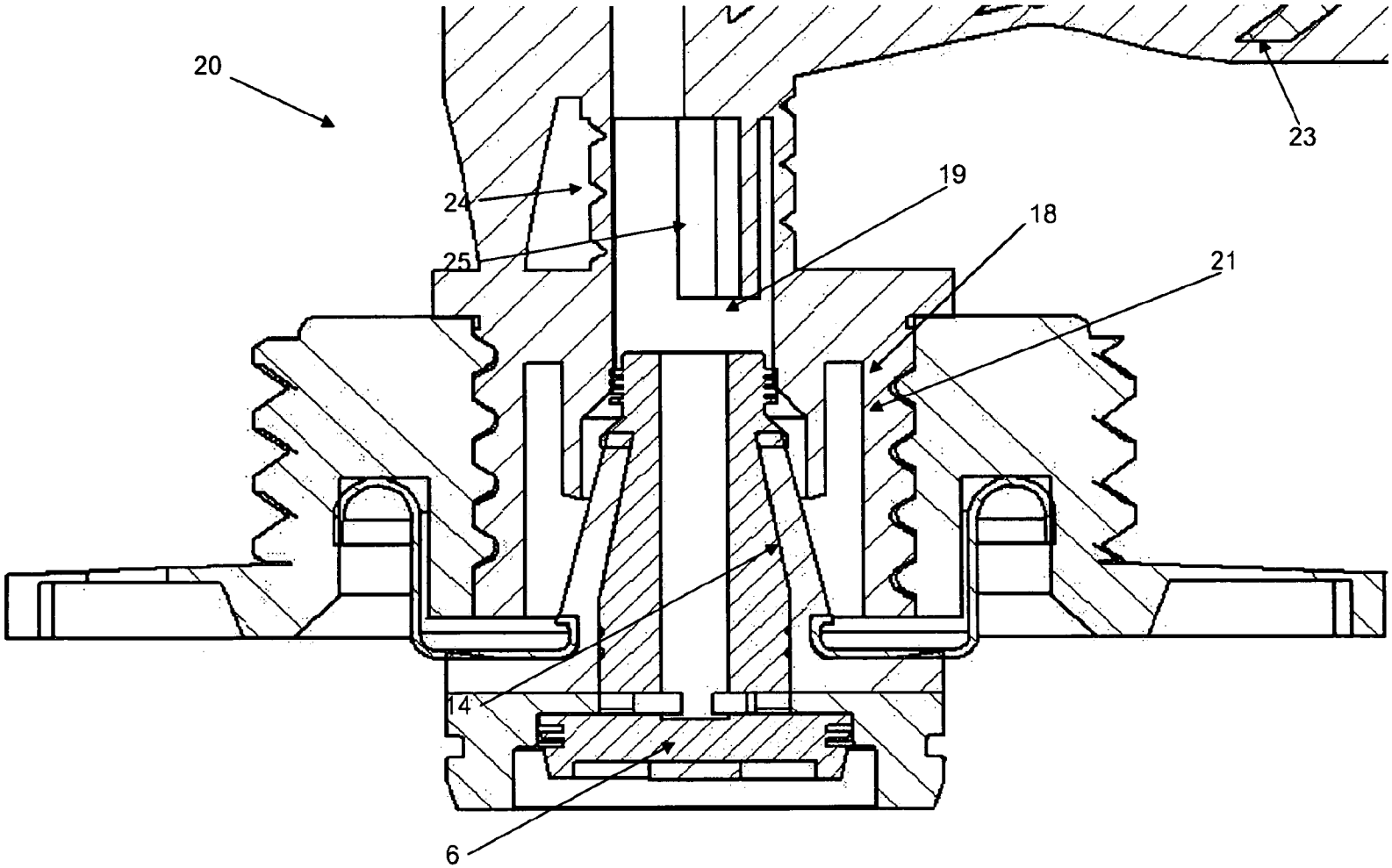
FIG. 9 schematically represents a foam applicator mounted onto the valve.

A foam applicator (20) for manual tilting is illustrated in FIG. 8 and more in detail in FIG. 9. The foam applicator (20) comprises a conical adaptor valve seat (19) with fitting onto the stem (6) by means of three disk-shaped resilient lip sections (18). The foam applicator (20) further comprises an additional sealing (21) for sealing the conical adaptor valve seat (19) to the second part (8) of the grommet (2).

Figure 10:
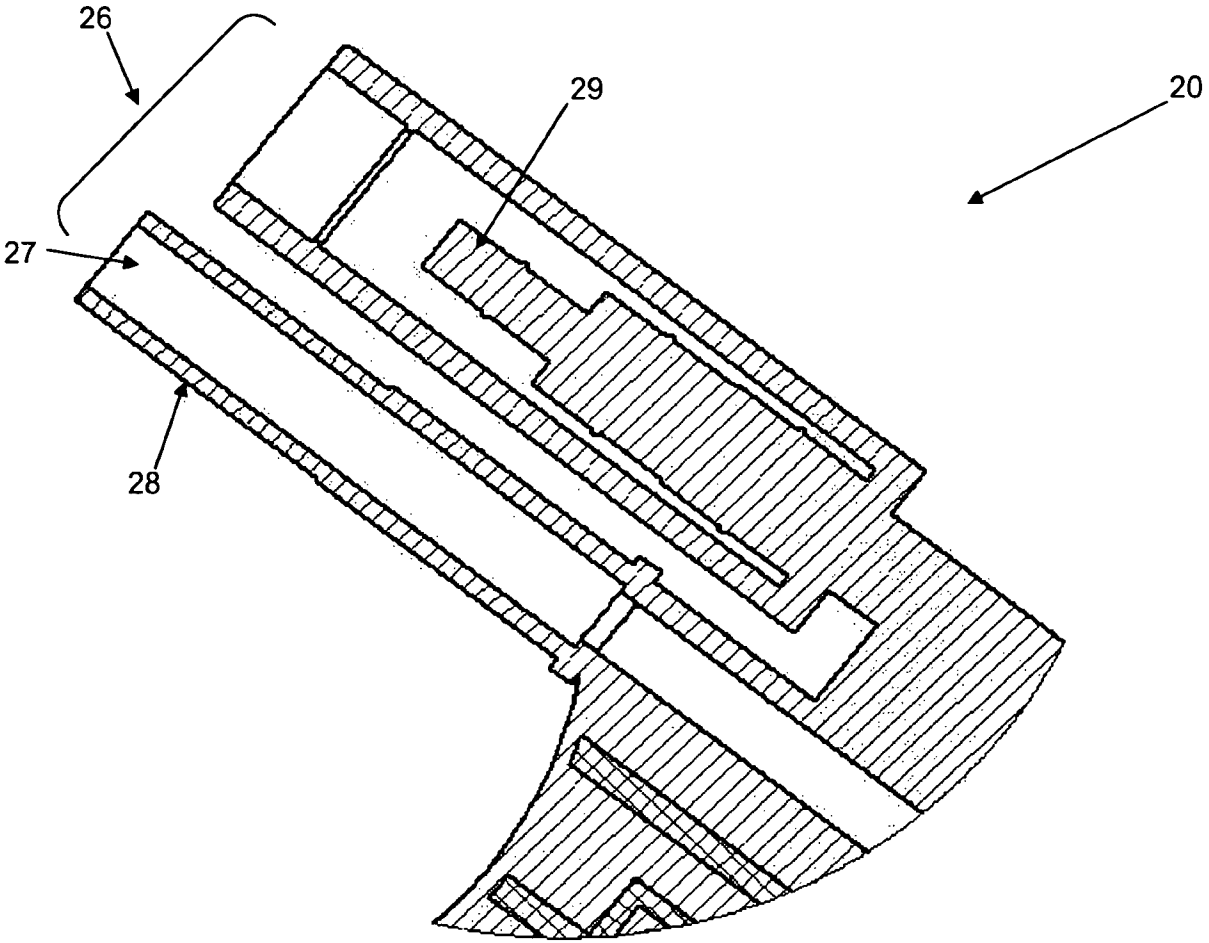
FIG. 10 schematically represents a multi-tubing concept of a foam applicator.
Figure 11:
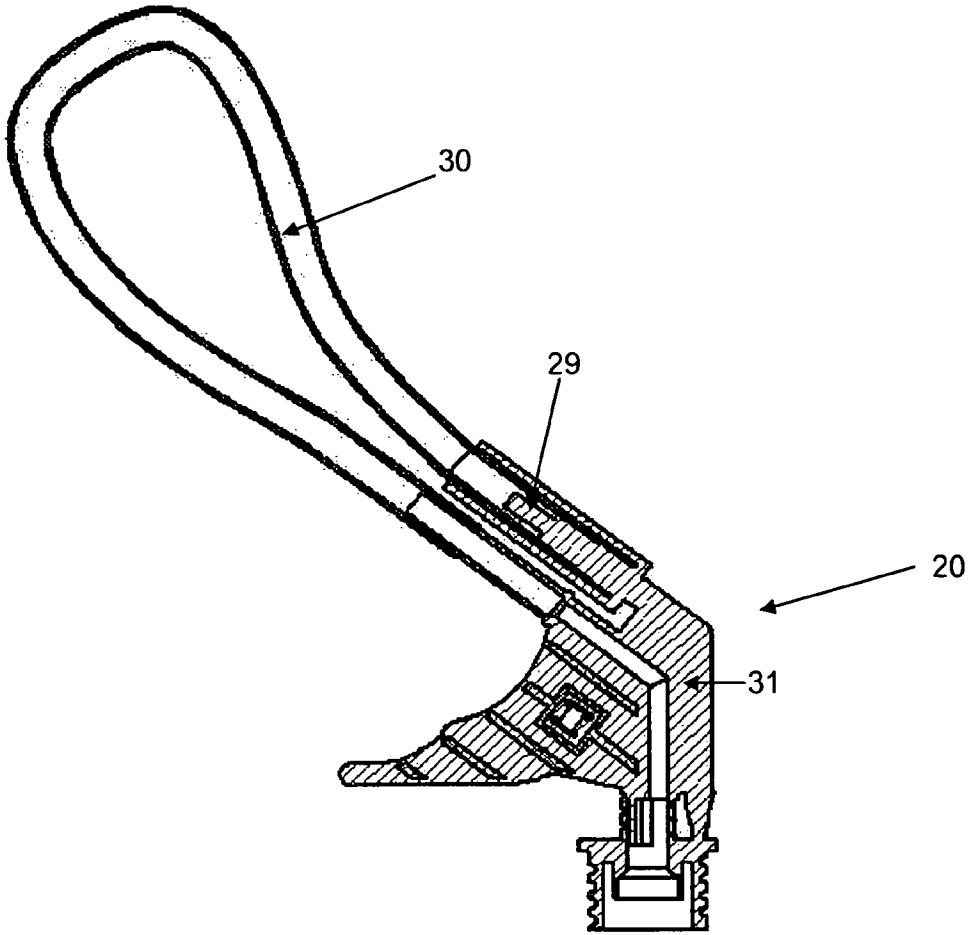
FIG. 11 schematically represents another embodiment of the foam applicator.
Figure 12:
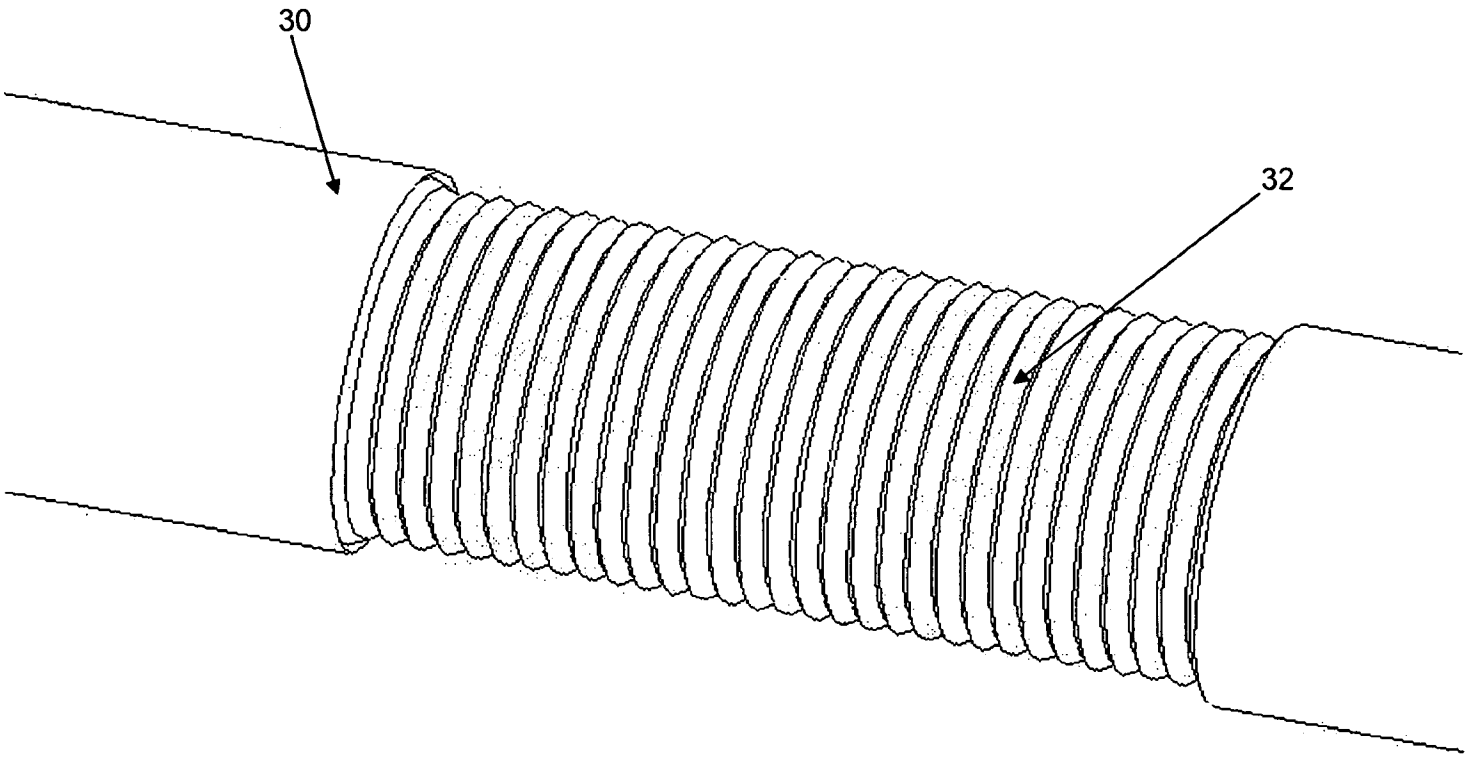
FIG. 12 schematically represents a tube with a harmonical part.

The foam applicator (20) comprises a tilting concept having a body (22), a lever (23), a fixed tilting point (24) and a cylindrical flexible bellow part (25) around the dispensing channel (14) of the stem (6). As illustrated in FIG. 10, the foam applicator (20) further comprises a multi-tubing concept (26) for mounting inside (27) or outside (30) different tube diameters onto the same foam applicator (20). As further illustrated in FIG. 11, a male/female multi-tube closing feature (29) can remain fixed onto the applicator (20) for closing the bended tube (30) or can be broken off in a weak zone (31) for mounting on the tube in front without bending the tube. The tube (31) can comprises a harmonica part (32), as illustrated in FIG. 12.

Figure 13:
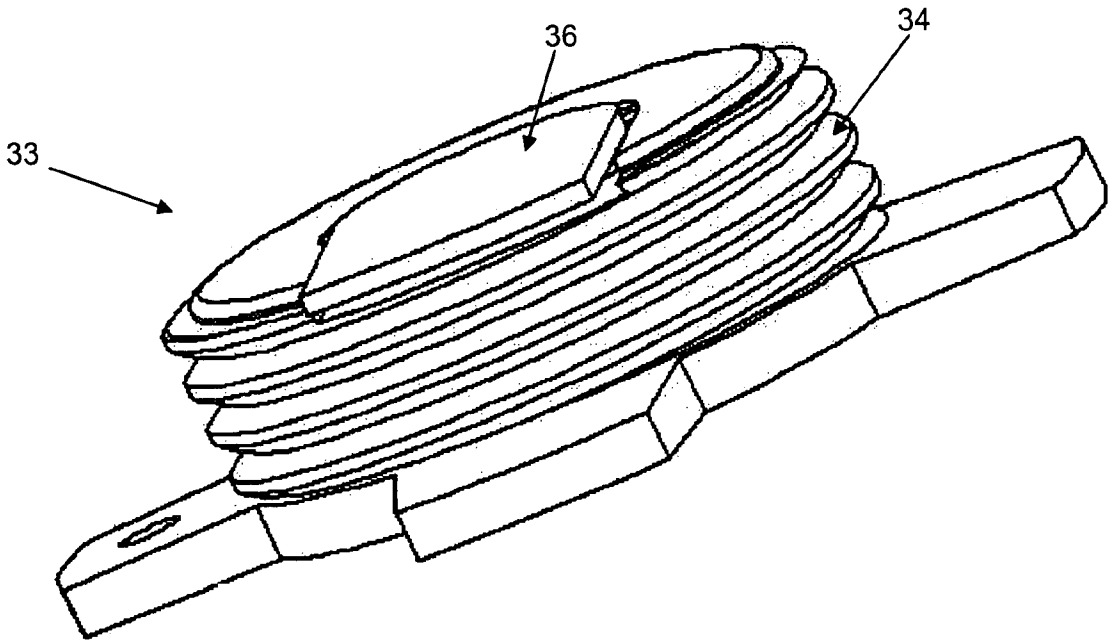
FIG. 13 schematically represents a multipurpose connection ring.
Figure 14:
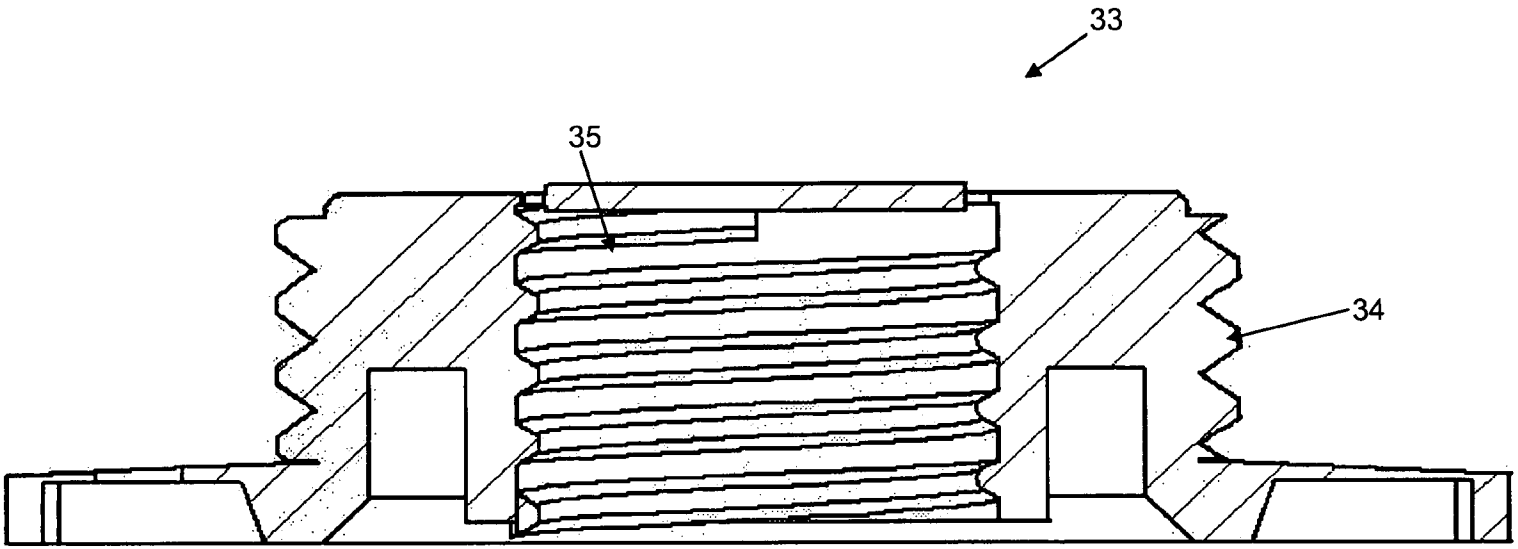
FIG. 14 schematically represents a multipurpose connection ring.

In a preferred embodiment, foam applicator (20) comprises a screw-on mechanism as illustrated in FIGS. 8 and 9. A thermoplastic multipurpose connection ring (33) is illustrated in FIG. 13 and more detailed in FIG. 14. The thermoplastic multipurpose connection ring (33) comprises an external thread (34) and an internal thread (35). The thermoplastic multipurpose connection ring (33) further comprises a stem protection and safety lid (36).

The neoprene rubber used in prior art grommets has been replaced by a grommet (2) comprising a combination of a first part (7) made of a hydrophobic thermoplastic material having a hardness of Shore D30 and a softer second part (8) made of a thermoplastic material having a hardness of Shore A77. Combining those thermoplastic materials having a different hardness guarantees adhesion of the first (7) and second part (8) on the interface. Thereby, the need for an additional process step, such as laser welding or injection molding to join both parts together is avoided.

By incorporation of a grommet (2) comprising a first part (7) having a hardness of Shore D30 adjacent to a second part (8), said second part having a lower hardness than said first part, the cost inefficient process step of moulding part of the grommet over the container cup is avoided. Further, as no overmoulding is required to fasten the valve (1) to the container's cup (9), the valve (1) can be assembled separately from the container, thereby simplifying production and reducing production cost.

The valve further needs to be moisture resistant. Therefore, the first part (7) of the grommet (2) is made of hydrophobic thermoplastic material. Since the chemical components present in the container are moisture sensitive and react with moisture and/or gas to form the final polymer, it should be acknowledged that any contact with ambient moisture is to be avoided in order to prevent the forming of the final polymer inside the can or vessel. Moisture diffuses via the valve system, more particular the rubber grommet in case of tilting valves.

The final polymer formed due to moisture diffusion/absorption inside the can or vessel sticks against the grommet and or the stem. Once the first layer of polyurethane is formed on the grommet on the face inside the can or vessel, the sealing properties of the valve diminish and make the valve subject to blocking and/or leaking.

The sealing of the stem (6) into the conical adaptor valve seat (19) of the foam applicator (20) is formed by three disk-shaped resilient lip sections (18) on the collar of the stem (6).

A preferred embodiment according to the present invention provides a thermoplastic multipurpose connection ring (33) as intermediate connection part for easy mounting on the foam applicator (20). The presence of the internal thread (35) assures easy inside mounting of the thermoplastic multipurpose connection ring (33) on the valve (1). The presence of an external thread (34) assures easy outside mounting of the foam applicator (20) on the thermoplastic multipurpose connection ring (33). Further, the stem protection and safety lid (36) prevents moisture diffusion/absorption inside the valve (1) when the thermoplastic multipurpose connection ring (33) is mounted onto the valve (1).

The foam applicator (20) is placed onto the thermoplastic multipurpose connection ring (33) by means of the screw-on mechanism, as illustrated in FIG. 7 and FIG. 8. When pressure is executed on the lever (23) of the tilting concept of the foam applicator (20), the cylindrical flexible bellow part (25) around the stem (6) puts pressure against the fixed tilting point (24). The stem (6) changes from a closed position to an open position and foam is dispensed from the inlet (14*a*) to the outlet (14*b*) of the dispensing channel (14) of the stem (6). The foam applicator (20) further comprises a multi-tubing concept (26) for mounting inside (27) or outside (30) different tube diameters onto the same foam applicator (20). A male/female multi-tube closing feature (29) can remain fixed onto the applicator for closing the bended tube (30). The tube (30) can comprise a harmonica part (32).

In another embodiment according to the invention, the male/female multi-tube closing feature (29) is broken off in a weak zone (31) for mounting on the tube in front without bending the tube (30).

Figure 15:
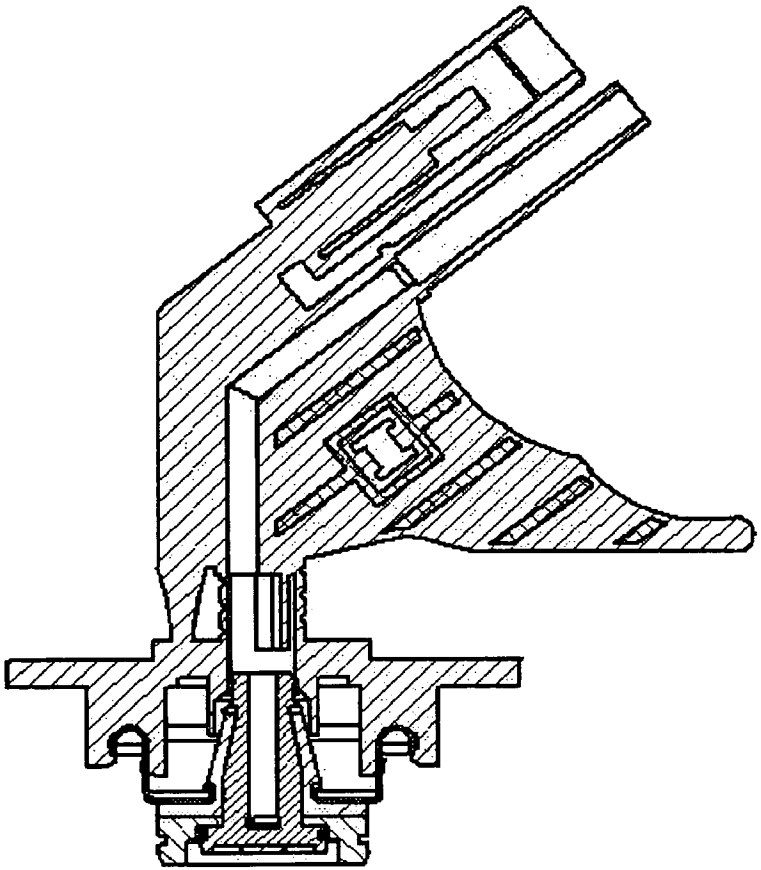
FIG. 15 schematically represents another embodiment of a foam applicator.
Figure 16:
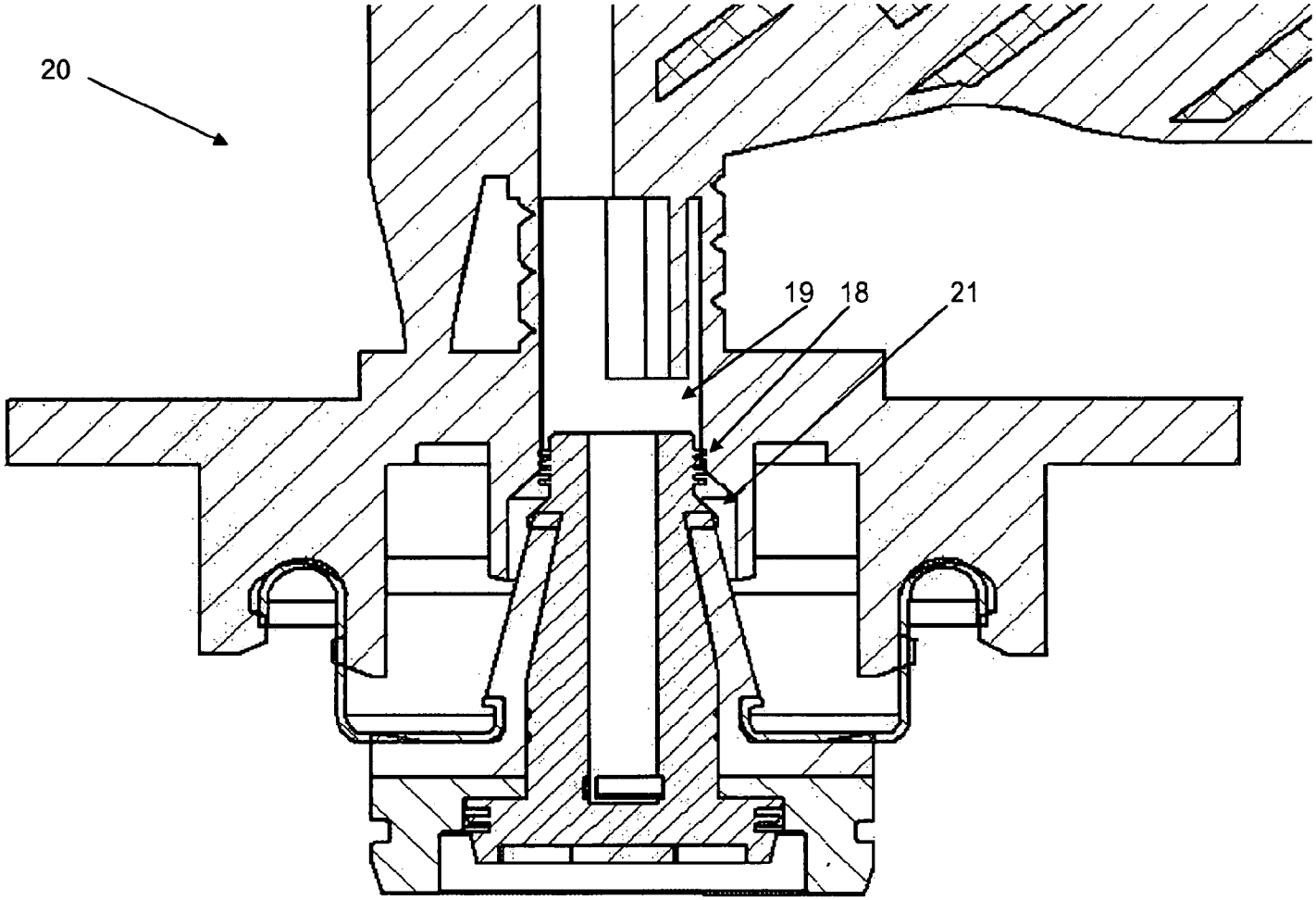
FIG. 16 schematically represents another embodiment of a foam applicator.

In another embodiment of the invention, the foam applicator (20) comprises a clips-on mechanism on the container's cup (9) to clip-on a foam applicator (20), illustrated in FIG. 15 and more in detail in FIG. 16.

According to another embodiment of the invention, the aerosol valve (1) according to the invention may be used as a tilting valve or a gun (vertical displacement) valve.

Figure 17:
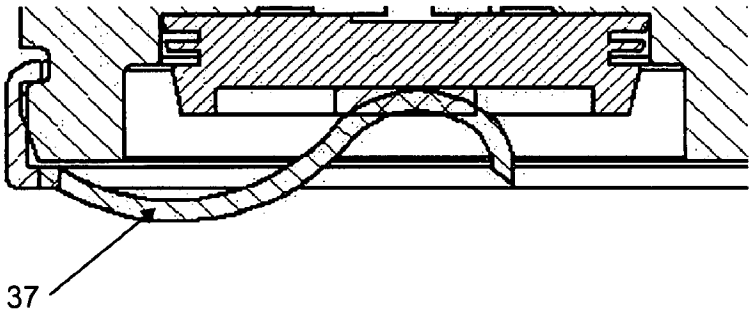
FIG. 17 schematically represents a valve comprising a spring.

As illustrated in FIG. 17 and according to another embodiment of the invention, the aerosol valve (1) according to the invention can comprise a spring mechanism (37) mounted on the first part (7) of the grommet (2) to assist the closing of the valve at filling.

Figure 18:
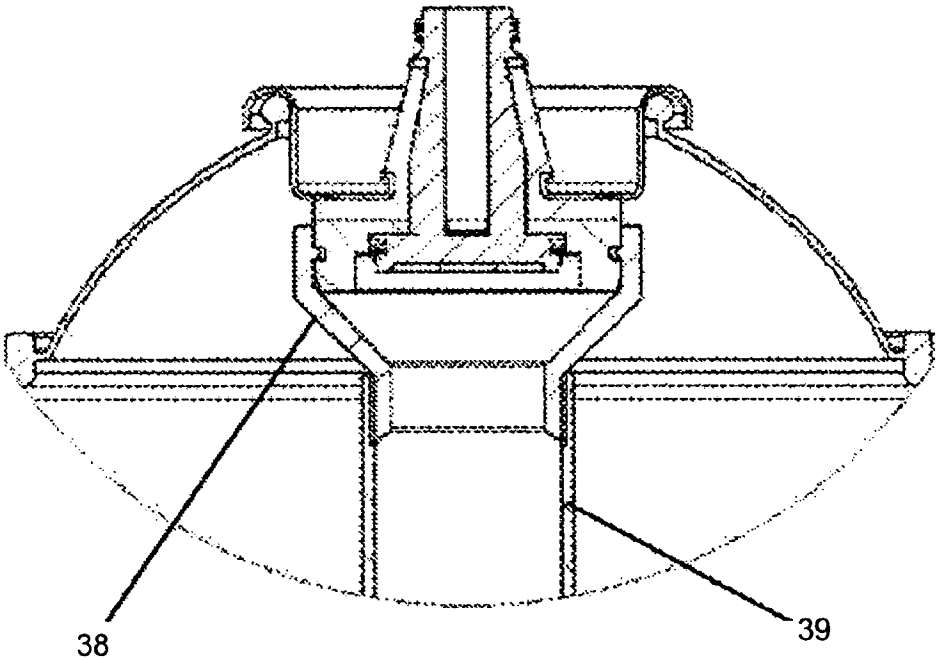
FIG. 18 schematically represents another embodiment of valve. The valve comprising a housing for mounting a dip tube.

According to another embodiment of the invention, the valve can be modified for spraying in a vertical position (instead of upside down) by means of a housing (38) with dip tube (39) onto the base of the grommet (2), illustrated in FIG. 18.

Having described the valve, it is believed that other apparatus and/or containers comprising a valve according to the invention will be suggested to those skilled in the art in view of the description set forth above. It is therefore to be understood that all such apparatus and/or containers are believed to fall within the scope of the invention as defined in the appended claims.

A person skilled in the art will also understand that the embodiments described above are merely illustrative in accordance with the present invention and not limiting the intended scope of the invention. Other embodiments and applications may also be considered.

The invention claimed is:

1. A valve for a container, said valve comprising:

a grommet; and a stem slideably arranged in a channel, wherein said grommet defines said channel with an inlet end and an outlet end, the grommet comprising a first part defining the inlet end of said channel and a second part defining the outlet end of said channel, said second part surrounds said stem about a vertical axis and, wherein said first part has a hardness higher then the hardness of said second part, wherein said stem further comprises at least a first and a second resilient lip section for providing sealing contact with the first part of the grommet, said first resilient lip section being larger in diameter and more resilient than the second resilient lip section, wherein said stem further comprises at least one circular sealing lip assuring sealing between said stem and the second part of the grommet.

2. The grommet according to claim 1, whereby said first part is of a thermoplastic material and said second part is of a thermoplastic elastomer.

3. The grommet according to claim 2, whereby said first part is a hard thermoplastic material and said second part is a soft thermoplastic elastomer.

4. A grommet according to claim 1, wherein at least said first part is hydrophobic.

5. A grommet according to claim 4, wherein said first part has a hardness of at least Shore D25.

6. A grommet according to claim 5, wherein said second part has a hardness in the range between Shore A35 and Shore A90.

7. A grommet according claim 1, wherein said second part comprises at least one inwardly sealing lip for providing sealing contact with a stem.

8. A grommet according to claim 1, wherein said first part is provided with an outwardly extending sealing lip arranged to provide sealing with a container cup wherein the grommet is provided.

9. The grommet according to claim 8, characterized in that incisions are provided in the sealing lip.

10. A valve according to claim 1, wherein the stem further comprises at least one dispensing channel, said channel comprises an inlet and an outlet, the inlet being arranged such that contact with the second part of the grommet is avoided.

11. The valve according to claim 1, wherein there is provided a housing for mounting a dip tube at the base of the grommet such that the pressurized fluid can reach the outlet passage via said tube.

12. An assembly for a container, comprising:

a valve according to claim 1, and a foam applicator comprising a body with a tilting lever for manual tilting, said body having a fixed tilting section opposite to a flexible bellow part around a dispensing channel of the stem, wherein said foam applicator is arranged to be snapped onto the container's cup.

* * * * *